United States Patent [19]

Burke

[11] 4,265,638

[45] May 5, 1981

[54] SYNTHETIC FUEL FORMULATION AND PROCESS FOR PRODUCING THE SAME

[75] Inventor: Courtney L. Burke, Simi Valley, Calif.

[73] Assignee: Albert M. Eisner, Los Angeles, Calif. ; a part interest

[21] Appl. No.: 109,550

[22] Filed: Jan. 4, 1980

[51] Int. Cl.[3] ..... C10L 1/18

[52] U.S. Cl. ..... 44/56; 44/77

[58] Field of Search ..... 44/53, 56, 77

[56] References Cited

U.S. PATENT DOCUMENTS

| | | | |
|---|---|---|---|
| 2,789,891 | 4/1957 | Brandes et al. | 44/56 |
| 3,902,868 | 9/1975 | Zoch, Jr. | 44/56 |

*Primary Examiner*—Jacqueline V. Howard

*Attorney, Agent, or Firm*—Lyon & Lyon

[57] ABSTRACT

A synthetic fuel formulation is disclosed, together with a process of producing such synthetic fuel. Based on its total weight, the fuel is comprised of approximately fifty to about seventy-five percent of an aliphatic hydrocarbon alcohol containing two to eleven carbon atoms, about five to twelve percent water, approximately two or twenty weight percent of a solvent for the alcohol, and about one to about seven weight percent of a hydrocarbon glycol, acetone, and methyl ethyl ketone. Optional ingredients may also be included, such as anti-rust and anti-foaming agents, as well as an agent to increase the storage life of the fuel. To produce such synthetic fuel, the foregoing ingredients are mixed sequentially, starting with the alcohol and adding thereto the solvent, acetone, optional agents if utilized, methyl ethyl ketone, the glycol, and water.

11 Claims, No Drawings

SYNTHETIC FUEL FORMULATION AND PROCESS FOR PRODUCING THE SAME

BACKGROUND OF THE INVENTION

As is well known, the United States presently is confronted with an energy crisis of untold magnitude. Our dependence upon foreign sources of petroleum has caused widespread consternation and frustration, particularly at the present time due to the decreasing supplies available and the rapidly increasing prices attached to the supply. The principal focus of the petroleum shortage, of course, is the automobile which is powered by an internal combustion engine operated virtually exclusively by gasoline.

There is thus a heightened interest today in finding ways to decrease the consumption of gasoline. One current example is "gasohol", which is essentially a mixture of gasoline and relatively small quantities of methanol, as for example, up to approximately ten percent methanol, which accordingly decreases the consumption of gasoline slightly. Nevertheless, in view of the significant number of automobiles utilized in this country alone, there is a critical need for a formulation to permit a significantly greater decrease in the consumption of gasoline.

Producing a synthetic fuel as a substitute for gasoline suitable for use in internal combustion engines, however, on a widespread scale is not an easy task. The synthetic fuel must not only combust efficiently to power the vehicle, but must also do so without the formation of excessive quantities of non-volatle or "gummy" materials that would be detrimental to the continued operation of the internal combustion engine. Additionally, the synthetic fuel, of course, must be able to satisfy such requirements without producing significant quantities of air polluting components upon combustion and exhaustion to the atmosphere. Moreover, the fuel must enable the engine to operate under the normally severe driving conditions of the automobile over continuing periods of time without overheating or contributing to other undesirable disadvantages.

SUMMARY OF THE INVENTION

A synthetic fuel has been discovered which alleviates many of the foregoing concerns and which does not contain gasoline as one of its component ingredients. The formulation, based upon its total weight, comprises between approximately fifty and seventy-five weight percent of an aliphatic hydrocarbon alcohol containing from two to eleven carbon atoms, about five to about twelve weight percent water, about two to about twenty weight percent of an aromatic hydrocarbon solvent compatible with the alcohol, and about one to about seven weight percent each of a hydrocarbon glycol, acetone, and methyl ethyl ketone. Certain optional ingredients, such as anti-rust, anti-foaming and other agents to improve storage life may also be utilized in the formulation, as will be understood more clearly from the description following herinafter. In producing such formulation, it has been found that the sequence of adding the components ingredients is quite significant in order to achieve uniform and thorough mixing of the ingredients without layering. Accordingly, the solvent is added to the alcohol, followed by acetone, the optional ingredients if used, methyl ethyl ketone, the glycol and water.

In addition to the absence of gasoline as one of its principal benefits, the synthetic fuel of the present invention will not affect adversely the normal operation of the automobile engine as for example by overheating, nor will the engine be deprived of the necessary lubrication obtained from components found in gasoline. By the same token, because of its formulation, the synthetic fuel will not contribute adversely to air pollution.

DETAILED DESCRIPTION OF THE INVENTION

As indicated above, the synthetic fuel contains, as a principal ingredient, an aliphatic hydrocarbon alcohol containing from two to eleven carbon atoms, and preferably from two to six carbon atoms, as, for example, isopropyl alcohol, ethyl alcohol or butyl alcohol, to provide the necessary hydrocarbon component for combustion and powering of the internal combustion engine. The preferred alcohol is isopropyl alcohol, since it is inexpensive compared to the other alcohols. The percentage of the alcohol may vary from approximately fifty percent to about seventy five weight percent, with the lower percentage being dictated primarily by the minimum quantity of alcohol necessary to provide efficient combustion and the upper limit by considerations of cost, together with the need for additional components in fuel as is discussed hereinafter. The preferred quantity of alcohol is between about fifty and sixty weight percent, and the preferred alcohols are those containing from two to six carbon atoms since such alcohols are more miscible with water.

In preparing the fuel of the present invention, as indicated previously, the aromatic hydrocarbon solvent is added to the alcohol, in a quantity of between approximately two to twenty percent by weight. The preferred aromatic solvents are xylene, toluene and benzene, with xylene being particularly preferred as the solvent for the alcohol. The quantities of the solvent are governed primarily by the minimum quantity necessary to function as the solvent for the alcohol and, with respect to the maximum percentage, considerations of cost, air pollution, and smooth, efficient operation of the engine. Acetone, which functions as a cleaning agent in the synthetic fuel to enable the fuel to burn cleanly and also to blow out excess carbon, is next added in a percentage of approximately one to about seven weight percent. Methyl ethyl ketone, if the optional ingredients specified hereinafter are not utilized, is next added in a quantity of about one to about seven weight percent, and performs essentially the same function as the acetone. An aliphatic hydrocarbon glycol, namely, ethylene glycol or propylene glycol, is next added, also in a quantity of about one to about seven weight percent, which functions as a lubricant in the fuel to assist in attaining the necessary performance without overheating or otherwise damaging the engine. Finally, water in a quantity of approximately five to twelve weight percent is added, which also serves as a cleaning agent for carbon formed upon combustion.

In addition, as indicated above, certain optional ingredients may be used. Thus, anti-rust and anti-foaming agents, such as ethylene glycol methyl ether and diethylene glycol methyl ether, commercially available from the Dow Chemical Company under the trademarks Dowanol EM and DM, may be used in quantities between about one and about seven percent by weight. By the same token, to increase the storage life of the fuel, diethylene glycol ethel ether, also available from the Dow Chemical Company under the trademark Dowanol DE may be used in a quantity between about one and about seven weight percent. If such optional ingredients are included they are added after the acetone, as shown in the example following.

A particularly preferred embodiment of the synthetic fuel of this invention is shown by the following example in which two thousand gallons were prepared by mixing the indicated quantities and components sequentially as shown:

| MIXING ORDER BY VOLUME (2000 gal.) | | |
|---|---|---|
| GAL. | COMPONENT | PERCENTAGE |
| 1100 | Isopropyl Alcohol | .55 |
| 165 | Xylene | .0825 |
| 55 | Acetone | |
| 55 | Dowanol EM | |
| 165 | Dowanol DM | .2575 |
| 165 | Dowanol DE | |
| 20 | Methyl Ethyl Ketone | |
| 55 | Propylene Glycol | |
| 220 | Water | .11 |
| 2000 | | 100% |

It will be appreciated from the foregoing that a synthetic fuel has been developed that does not contain gasoline as a component and yet also is capable of providing the high performance necessary for operation of the commercial automobile. It is additionally significant to realize that such synthetic fuel is capable of attainment at a relatively low cost, in view of the comparatively inexpensive prices presently available for the component ingredients.

I claim:

1. A synthetic fuel comprising, based on the total weight of said fuel, approximately fifty to about seventy-five weight percent of an aliphatic hydrocarbon alcohol containing from two to eleven carbon atoms, about five to about twelve weight percent water, approximately two to about twenty weight percent of an aromatic hydrocarbon solvent compatible with said alcohol, and about one to about seven weight percent each of a hydrocarbon glycol selected from the group consisting of ethylene and propylene glycol, acetone and methyl ethyl ketone.

2. The synthetic fuel of claim 1 additionally containing about one to about seven weight percent of anti-rust and anti-foaming agents.

3. The synthetic fuel of claim 1 in which said alcohol contains from two to six carbon atoms.

4. The synthetic fuel of claim 3 in which said alcohol is isopropyl alcohol.

5. The synthetic fuel of claim 4 in which said solvent is xylene.

6. A synthetic fuel comprising, based on the total weight of said fuel, about fifty to about seventy-five weight percent isopropyl alcohol, about five to about twelve weight percent water, about two to about twenty weight percent xylene, about one to about seven weight percent each of propylene glycol, acetone, methyl ethyl ketone, and about one to about seven weight percent anti-rust and anti-foaming agents.

7. The synthetic fuel of claim 6 in which said anti-rust agent is ethylene glycol methyl ether and said anti-foaming agent is diethylene glycol methyl ether.

8. The synthetic fuel of claim 6 additionally containing about one to about seven weight percent of an agent to increase the storage life of said fuel.

9. The synthetic fuel of claim 8 in which said storage life agent is diethylene glycol ethyl ether.

10. A synthetic fuel comprising, based on the total weight of said fuel, approximately fifty to sixty percent isopropyl alcohol, approximately six to twelve percent xylene, approximately eight to twelve percent water, and approximately three to five percent each of acetone, methyl ethyl ketone, propylene glycol, diethylene glycol ethyl ether, diethylene glycol methyl ether, and ethylene glycol methyl ether.

11. A process for producing a synthetic fuel comprising mixing sequentially, based on the total weight of said fuel, approximately fifty to about seventy five weight percent of an aliphatic hydrocarbon alcohol containing from two to eleven carbon atoms, approximately two to about twenty weight percent of an aromatic hydrocarbon solvent compatible with said alcohol, about one to about seven weight percent of acetone, about one to about seven weight percent methyl ethyl ketone, about one to about seven weight percent of a hydrocarbon glycol selected from the group consisting of ethylene and propylene glycol, and about five to about twelve weight percent water.

* * * * *